US006904259B2

(12) United States Patent
Tsueda et al.

(10) Patent No.: US 6,904,259 B2
(45) Date of Patent: Jun. 7, 2005

(54) FIXING APPARATUS

(75) Inventors: Yoshinori Tsueda, Fuji (JP); Satoshi Kinouchi, Tokyo (JP); Osamu Takagi, Tokyo (JP); Toshihiro Sone, Fujieda (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/939,519

(22) Filed: Sep. 14, 2004

(65) Prior Publication Data

US 2005/0031389 A1 Feb. 10, 2005

Related U.S. Application Data

(63) Continuation of application No. 10/378,865, filed on Mar. 5, 2003.

(51) Int. Cl.[7] ..... G03G 15/20
(52) U.S. Cl. ..... 399/333; 399/67
(58) Field of Search ..... 399/69, 320, 328, 399/330, 331, 332, 333

(56) References Cited

U.S. PATENT DOCUMENTS

| | | | | |
|---|---|---|---|---|
| 5,331,385 | A | 7/1994 | Ohtsuka et al. | |
| 6,026,273 | A | 2/2000 | Kinouchi et al. | |
| 6,078,781 | A | 6/2000 | Takagi et al. | |
| 6,087,641 | A | 7/2000 | Kinouchi et al. | |
| 6,212,344 | B1 | 4/2001 | Takagi et al. | |
| 6,337,969 | B1 | 1/2002 | Takagi et al. | |
| 6,408,146 | B1 | 6/2002 | Nagano | |
| 6,438,335 | B1 | 8/2002 | Kinouchi et al. | |
| 6,643,476 | B1 | 11/2003 | Kinouchi et al. | |
| 6,643,491 | B2 | 11/2003 | Kinouchi et al. | |
| 6,687,482 | B2 | 2/2004 | Maeda et al. | |
| 6,724,999 | B2 | 4/2004 | Kikuchi et al. | |
| 6,725,000 | B2 | 4/2004 | Takagi et al. | |
| 6,763,206 | B2 | 7/2004 | Kinouchi et al. | |
| 2002/0118977 | A1 * | 8/2002 | Hasegawa et al. | 399/69 |
| 2004/0173603 | A1 | 9/2004 | Kinouchi et al. | |
| 2004/0175211 | A1 | 9/2004 | Sone et al. | |

FOREIGN PATENT DOCUMENTS

| | | | |
|---|---|---|---|
| JP | 8-129313 | A | 5/1996 |
| JP | 10-63126 | A | 3/1998 |
| JP | 2001-188427 | A | 7/2001 |
| JP | 2002-49261 | A | 2/2002 |

OTHER PUBLICATIONS

U.S. Appl. No. 10/387,413, filed Mar. 14, 2003, Kinouchi et al.

U.S. Appl. No. 10/390,645, filed Mar. 19, 2003, Takagi et al.

* cited by examiner

*Primary Examiner*—Hoan Tran
(74) *Attorney, Agent, or Firm*—Foley & Lardner LLP

(57) ABSTRACT

A fixing apparatus includes a fixing device configured to, by allowing a sheet having a developing agent image on it to pass between a heating roller and a pressing roller set in contact with the heating roller, fix the developing agent image in which at least one of the heating roller and pressing roller is configured to have an inner elastic layer and a conductive layer formed on a surface side of the elastic layer and the elastic layer is bonded to the conductive layer by a heat-resistant adhesive having a heat-resistant temperature of over 200° C.

16 Claims, 6 Drawing Sheets

FIXING APPARATUS

The present application is a continuation of U.S. application Ser. No. 10/378,865, filed Mar. 5, 2003, the entire contents of which are incorporated herein by reference.

BACKGROUND OF THE INVENTION

The present invention relates to a fixing apparatus for use, for example, in an image forming apparatus.

This type of fixing apparatus is disclosed, for example, in Jpn. Pat. Appln. KOKAI Publication Nos. 2002-49261, 2001-188427 and 10-63126.

A fixing roller of the fixing apparatus disclosed in Jpn. Pat. Appln. KOKAI Publication No. 2002-49261 has a cylindrical rigid body in which a layer of a lower heat conduction material, a conductive layer of an electroconductive material and a mold releasing layer are sequentially formed on an outer side of the rigid body. Near the fixing roller, an induction heating source is provided opposite to the outer peripheral surface of the roller.

By inductively heating the conductive layer of the fixing roller by means of the induction heating source it is possible to heat the fixing roller in a short time to a desired temperature.

A fixing apparatus disclosed in Jpn. Pat. Appln. KOKAI Publication No. 2001-188427 includes a heating member with a conductive layer formed on a hollow member and a magnetic field generating means arranged outside the heating member and generating a varying magnetic field on the conductive layer to achieve warm-up in a short time.

A fixing apparatus disclosed in Jpn. Pat. Appln. KOKAI Publication No. 10-63126 is of such a type that a conductive wire (Litz wire) is arranged around a peripheral surface portion other than a nip portion between a heating roller and a pressing roller and, by connecting the conductive wire to a high frequency oscillation section and applying a high-frequency current, it is possible to heat the surface of the heating roller. By applying heat to the surface of the heating roller, the fixing apparatus can reduce an energy loss and ensure a short rise time.

In the prior art, however, no consideration has been paid to the following problems likely to occur in a practical application.

1. How to deal with a breakage, separation, etc., of the layers (constituent elements) of the fixing roller resulting from their deterioration, etc., caused by prolonged use, etc.

2. How to deal with a slip caused between the layers.

3. Consideration to be paid to the positioning of a sheet separation blade when the fixing roller is deformed.

4. An adjustment of the roller hardness, heat conductivity and heat capacity, as well as an improvement of a resulting separation, fixability and warming-up time obtained by changing the material and layer thickness in the case where a heating rotation body and pressing rotation body are of such a type that a conductive layer is formed on their elastic layer.

BRIEF SUMMARY OF THE INVENTION

The present invention has been achieved with the above situations in view and the object of the present invention provides a fixing apparatus which has measures against problems likely to be produced in a practical application and can effectively utilize them in the case where either one or both of a heating rotation body and pressing rotation body have a conductive layer formed on an elastic layer.

In one aspect of the present invention there is provided a fixing apparatus including a fixing device configured to, by allowing a material to be fixed having on it a developing agent image to pass between a heating rotation body and a pressing rotation body set in pressure contact with the heating rotation body, fix the developing agent image, in which at least one of the heating rotation body and pressing rotation body has an elastic layer on an inner side and a conductive layer formed on a surface side of the elastic layer and in which the elastic layer and conductive layer are bonded by a heat-resistant adhesive having a heat-resistant temperature of over 200° C.

In another aspect of the present invention there is provided a fixing apparatus comprising a fixing device configured to, by allowing a material to be fixed having on it a developing agent image to pass between a heating rotation body and a pressing rotation body set in contact with the heating rotation body, fix the developing agent image, in which at least one of the heating rotation body and pressing rotation body is comprised of an elastic rotation body having a core member, an elastic layer formed on a surface of the core member and a conductive layer formed on a surface side of the elastic layer; a drive device configured to rotate the elastic rotation body by a giving a rotation drive force to the core portion of the elastic rotation body; and a detection device configured to detect a difference between rotation speeds of the surface portion and core portion at a rotation time of the elastic rotation body.

In another aspect of the present invention there is provided a fixing apparatus including a fixing device configured to, by allowing a material to be fixed having on it a developing agent image to pass between a heating rotation body and a pressing rotation body set in contact with the heating rotation body, fix the developing agent image, in which any one of the heating rotation body and pressing rotation body is configured to have an elastic layer and a conductive layer formed on a surface side of the elastic layer and the other rotation body is configured to have an elastic layer on a surface and the one rotation body is rotationally driven with the rotation of the other rotation body; and a detection device configured to detect a slip between the one and other rotation bodies from the difference between the peripheral speeds of these rotation bodies.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the present invention.

DETAILED DESCRIPTION OF THE INVENTION

The embodiments of the present invention will be described below with reference to the accompanying drawing.

Figure 1:
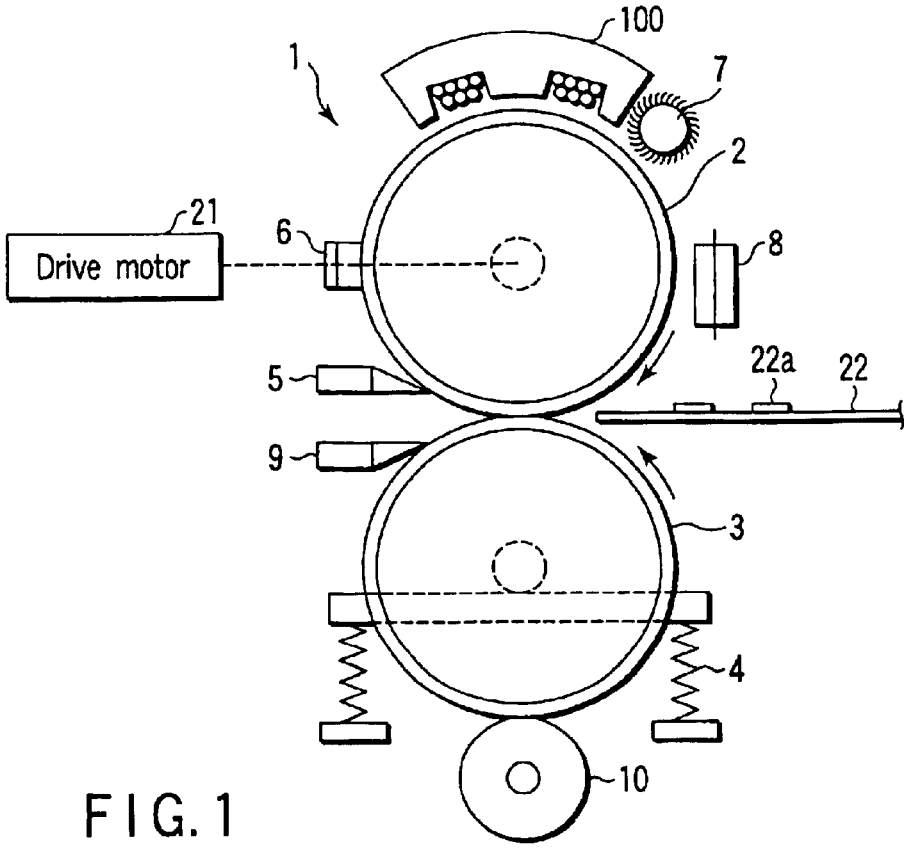
FIG. 1 is a schematic view showing a fixing apparatus according to a first embodiment of the present invention.

FIG. 1 is a schematic view diagrammatically showing a whole of a fixing apparatus 1 according to a first embodiment of the present invention.

Figure 2:
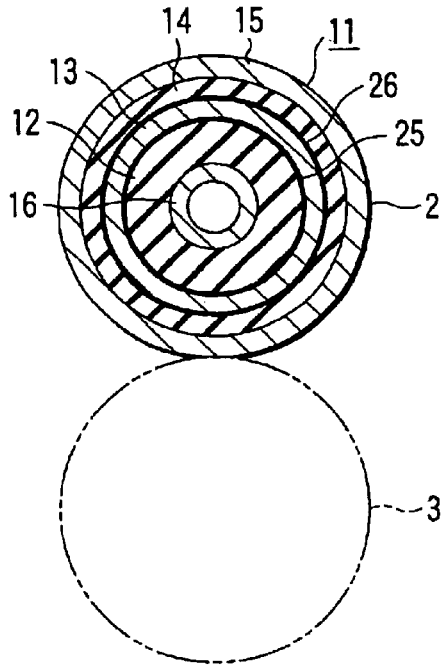
FIG. 2 is a cross-sectional view showing a heating roller of the fixing apparatus of FIG. 1.

The fixing apparatus 1 is provided in an image forming apparatus and is configured to have a heating (heat) roller 2 (diameter 40 mm) formed as a heating rotation body and a pressing (press) roller 3 (diameter 40 mm) formed as a pressure applying rotation body. As the heating roller 2 use is made of an endless member 11 as shown in FIG. 2. A detailed structure of the endless member 11 will be described below.

The pressing roller 3 is formed with a rubber such as silicone, fluorine, etc., covered on a peripheral surface of its core member. The pressing roller 3 is pressed by a pressure application mechanism 4 against the heating roller 2 and maintained to have a predetermined nip width.

The heating roller 2 is driven by a drive motor 21 in the direction of an arrow and the pressing roller 3 is rotated as a driven roller in a direction of an arrow.

A coil 100 for magnetic flux generation is provided above the upper side of the heating roller 2. The heating roller 2 is heated under the magnetic flux from the coil 100. A sheet 22 passes through a fixing site at a pressing portion (nip portion) between the heating roller 2 and the pressing roller 3 to allow a developing agent image 22*a* to be melted/pressed on the sheet 22 and fixed to the sheet.

Around the heating roller 2 a separation claw 5, thermostat 6, cleaning member 7 and thermostat 8 are arranged in the rotation direction of the heating roller.

The separation claw 5 is used to separate the sheet 22 from the heating roller 2. The thermistor 6 is arranged in plural numbers in the longitudinal direction of the heating roller 2 to detect the temperature of the heating roller 2. Based on the detection temperature of the thermistor the temperature of the heating roller 2 is adjusted by a temperature controlling device not shown.

The cleaning member 7 is used to remove a toner offset on the heating roller 2 and dirt, etc., such as sheet dust. As the thermostat, at least one is provided over the heating roller 2 and configured to detect any abnormal surface temperature of the heating roller 2 and shut off the heating.

Around the circumference of the pressing roller 3, a separation claw 9 is provided for separating the sheet 22 from the pressing roller 3 and a cleaning roller 10 is provided for removing the toner.

FIG. 2 is a cross-sectional view showing the endless member 11 constituting the heating roller 2.

The endless member 11 has the core member 16 on which an elastic layer 12, conductive layer 13, elastic layer 14 and mold releasing layer 15 are formed in this order.

The elastic layer 12 is formed of, for example, a silicone rubber or foam rubber and the conductive layer 13 is formed of, for example, nickel. The elastic layer 14 is formed of, for example, silicone rubber and the mold releasing layer is formed of, for example, PFA.

By doing so, the conductive layer 13 is inductively heated and thus heated near the surface of the endless member 11. It is, therefore, possible to secure better energy efficiency and to expect a rapid temperature rise of the heating device.

Further, by adjusting the thickness of the conductive layer 13 and elastic layers 12 and 14 and hardness of their material, it is possible to adjust the hardness of the endless member 11 as well as to adjust the nip width and separation performance. These merits are thus obtained.

In the present embodiment, a foam rubber of 4.73 mm thick is used as the elastic layer 12, a nickel of 40 $\mu$m thick as the conductive layer 13 and a silicone rubber of 200 $\mu$m thick as the elastic layer 14. As the mold releasing layer 15 use is made of PFA of 30 $\mu$m thick and as the core material 16 use is made of iron of 1.5 mm.

Heat-resistant adhesives 25 and 26 having a heat-resistant temperature of over 200° C. are used to achieve a bond at a boundary between the elastic layer 12 and the conductive layer 13 and at a boundary between the conductive layer 13 and the elastic layer 14.

At the time of fixing, the surface of the heating roller 2 is heated up to about 200° C. Further, the heating roller 2 and pressing roller 3 also have the function of conveying the sheet and it is necessary to fix the layers 12, 13 and 14 to each other so that, at the time of fixing, these layers may not slip along each other. From this viewpoint the heat-resistant adhesives 25 and 26 having a heat-resistant temperature of over 200° C. are used to fix the layers 12, 13 and 14 to each other.

According to the present invention it is possible to prevent slippage of these layers 12, 13 and 14 as well as their separation from each other.

Figure 3:
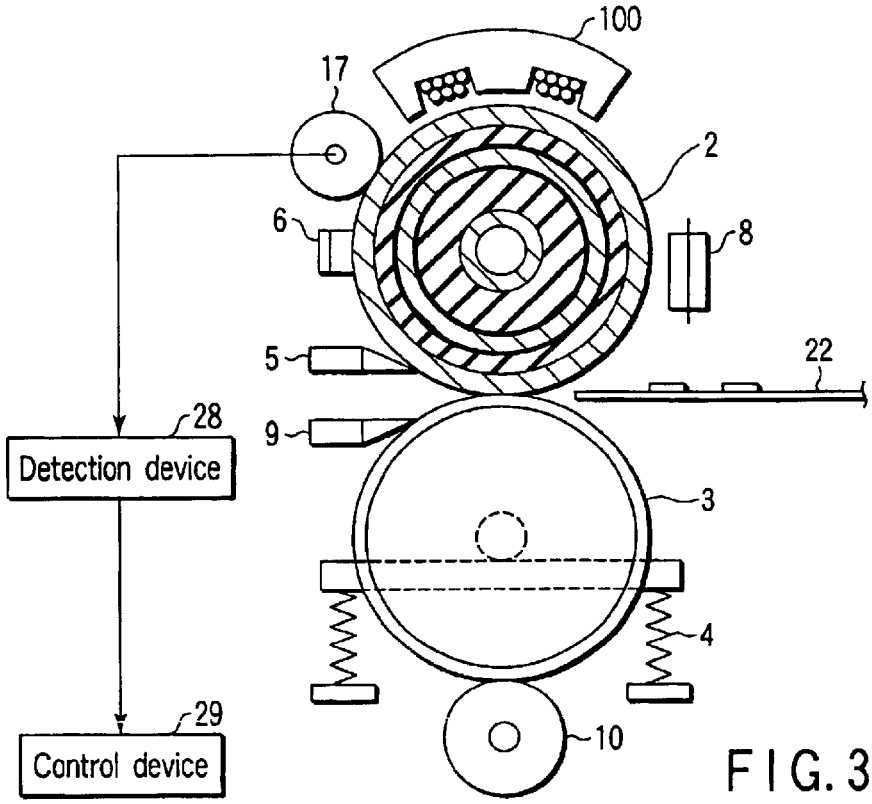
FIG. 3 is a schematic view showing a fixing apparatus according to a second embodiment of the present invention.

FIG. 3 shows a fixing apparatus according to a second embodiment of the present invention. The same reference numerals are employed here to designate parts or elements corresponding to those shown in the first embodiment and further explanation of these are omitted here.

A detection roller 17 is situated more on a downstream side as viewed in a rotation direction of a heating roller 2 than a thermistor 6 and is contacted with the heating roller 2. The detection roller 17 is urged against the heating roller 2 by an urging mechanism not shown. It is to be noted here that there arises no problem if the detection roller 17 is provided more on an upstream side as viewed in the rotation direction of the heating roller than the thermistor 6.

An encoder (not shown) for example is mounted on a rotation shaft of the detection roller 17 and the angular velocity of the detection roller 17 can be detected by a detection device 28. When the heating roller 2 is rotated by receiving a drive force at a core member 16, the detection roller 17 is rotationally driven and the peripheral speed of the detection roller 17 becomes equal to that of the heating roller 2.

By initially knowing the radius of the detection roller 17 and detecting the angular velocity of it, it is possible to calculate the peripheral speed of the speed detection roller 17 and know the peripheral speed of the heating roller 2. In this embodiment, the speed detection roller 17 also acts as a cleaning roller for the heating roller 2.

Figure 4:
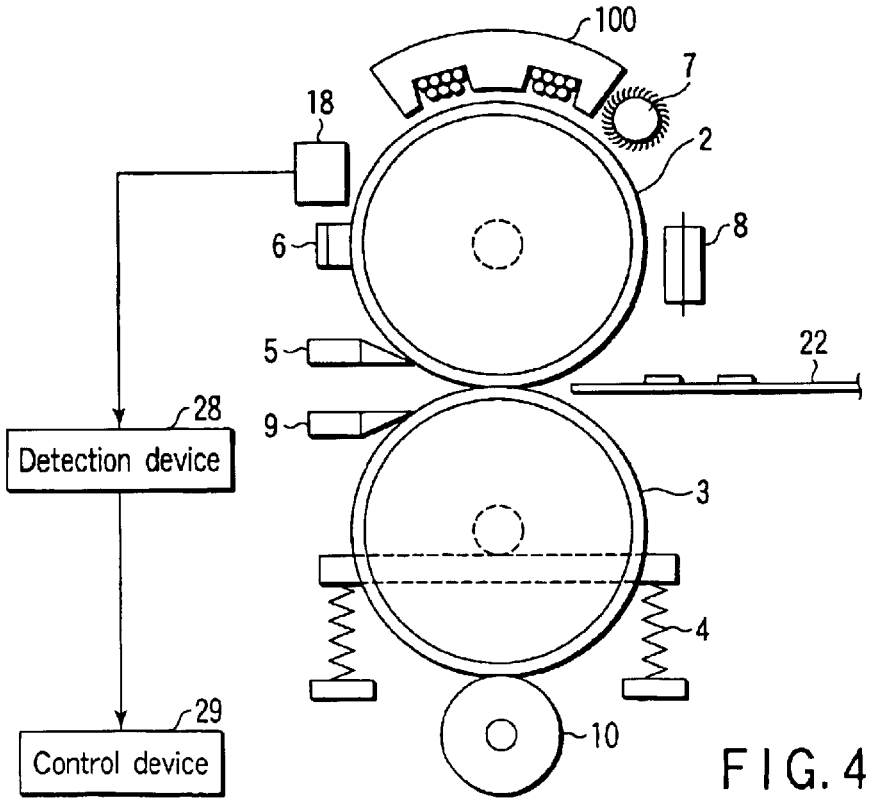
FIG. 4 is a view showing a detection device of the fixing apparatus of FIG. 3.
Figure 5:
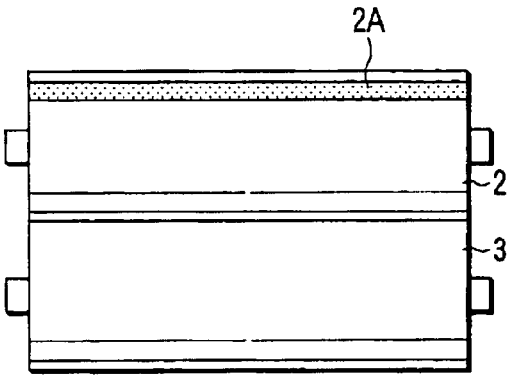
FIG. 5 is a view showing a mark formed on a heating roller of the fixing apparatus of FIG. 3.
Figure 6:
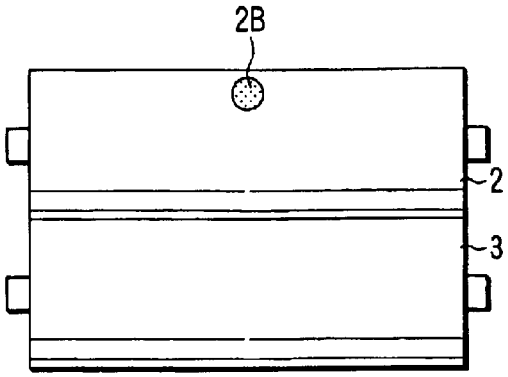
FIG. 6 is a view showing another mark formed on a heating roller of the fixing apparatus of FIG. 3.

FIGS. 4 to 6 show another practical form for detecting the peripheral speed of a heating roller 2.

In this practical form, as shown in FIG. 4, an optical reading element 18 such as a photocoupler is set near and opposite a position where the surface of the heating roller 2 can be taken as an image. As shown in FIG. 5, a line 2A of a color different from the surface color of the heating roller 2 is formed on a surface portion of the heating roller 2 or mark 2B as shown in FIG. 6 is formed on a surface portion of the heating roller.

At the rotating time of the heating roller 2, the line 2A or the mark 2B is read out by the optical reading element 18 to detect the angular velocity of the heating roller 2. By doing so, the peripheral speed is calculated from the relation to the radius of the heating roller 2. Although, in this practical form, the peripheral speed of the heating roller 2 is detected, the speed of the heating roller 3 can, needless to say, also be detected in the same method as set out above.

An endless member 11 as used in this practical form is comprised of a plurality of layers 12, 13 and 14 of different mechanical strengths and it may be predicted that a breakage or a layer-to-layer separation will occur in relatively weak elastic layers 12 and 14. In an image forming apparatus using such a practical form, a self-diagnostic routine using the speed detection means is incorporated so a to detect a breakage of such members.

Figure 7:
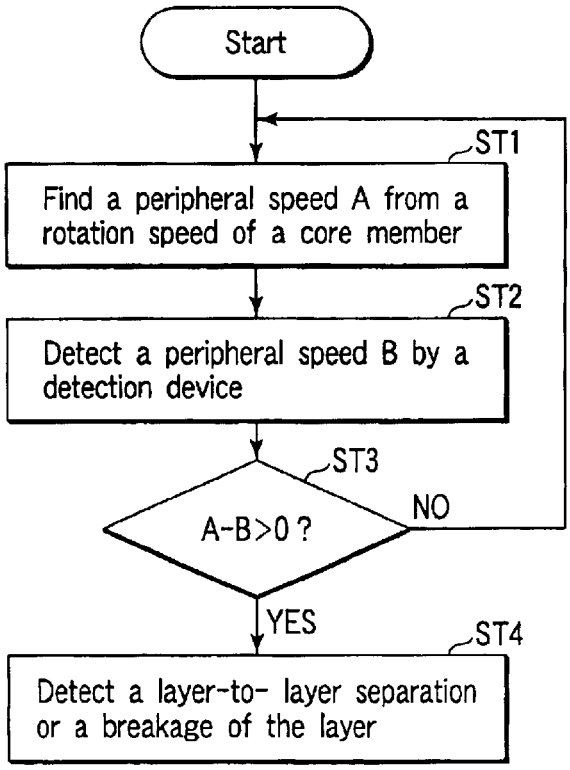
FIG. 7 is a flowchart showing the operation of the detection device of FIG. 4.

FIG. 7 is a flowchart showing a self-diagnosis routine.

In this self-diagnosis routine, the peripheral speed A of the heating roller 2 is found by a calculation from a relation between the rotation speed (angular velocity) by a drive force loaded on a core member 16 of the heating roller 2 and the radius of the heating roller 2 (step ST1). At the same time, the peripheral speed B of the heating roller 2 is detected by the use of the speed detection roller 17 as set out above (step ST2). Then, in order to decide the large/small relation of the peripheral speeds A and B, a difference A−B is found at step ST3.

These peripheral speeds A, B become equal in the case where no breakage occurs in the heating roller 2. If any breakage occurs in the heating roller 2, a rotation slip occurs at the broken portion and an outer side portion than the broken portion is rotated at a lower speed than that of an inner side portion or no rotation occurs.

For this reason, the roller peripheral speed B is lower than the roller peripheral speed A. If, from this, A−B>0, it is decided that the roller 2 is broken (step ST4). In this case, the operation of the image forming apparatus is stopped by a control device 29 and, in order to give the user, service personnel, etc., a notice to the effect that breakage has occurred or an exchange of component parts is required, it is displayed, for example, on a display panel of an operation section of the image forming apparatus. This self-diagnosis routine always works when the heating roller 2 as a speed detection target is rotating.

Although, in this practical form, the speed difference is used for comparison between the peripheral speeds A and B, the present invention is not restricted to this and it is also possible to use the speed ratio. Any comparison method may be used if the large/small relation between the peripheral speeds A and B can be compared.

Although, in this practical form, the image forming apparatus is stopped in the case where any breakage of the heating roller 2 is detected by the self-diagnosis routine, only the fixing apparatus, rotation of the heating roller 2 or heating operation may be stopped.

Further, although, in this practical form, the self-diagnosis routine has been explained as always working when the roller as a speed detection target is rotating, it may be made to always work during the operation of the image forming apparatus. The scope of the present invention is not restricted to the time when the self-diagnosis works.

Figure 8:
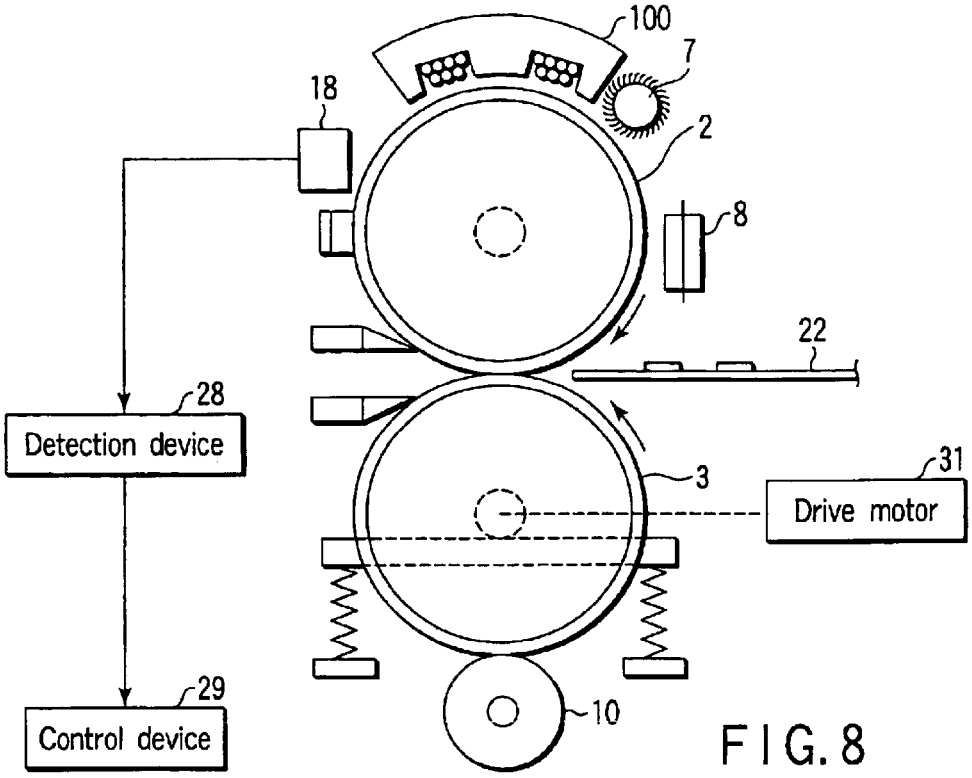
FIG. 8 is a schematic view showing a fixing apparatus according to a third embodiment of the present invention.

FIG. 8 is a schematic view showing a third embodiment of the present invention. It is to be noted that the same reference numerals are employed here to designate parts or component elements corresponding to those shown in the first embodiment. And further explanation of them is, therefore, omitted.

Although, in the second embodiment, the heating roller 2 is rotated by applying a drive force to the heating roller 2 and, by doing so, the pressing roller 3 is rotationally driven, the third embodiment is such that a pressing roller 3 is rotated upon receipt of a rotation force from a drive motor 31 and, by doing so, a heating roller 2 is rotationally driven.

The peripheral speed D of the heating roller 2 is detected by the same method as that of the second embodiment. Details of it are omitted. In the image forming apparatus used in this invention, a slip between the rotationally driven heating roller 2 and the pressing roller 2.

Figure 9:
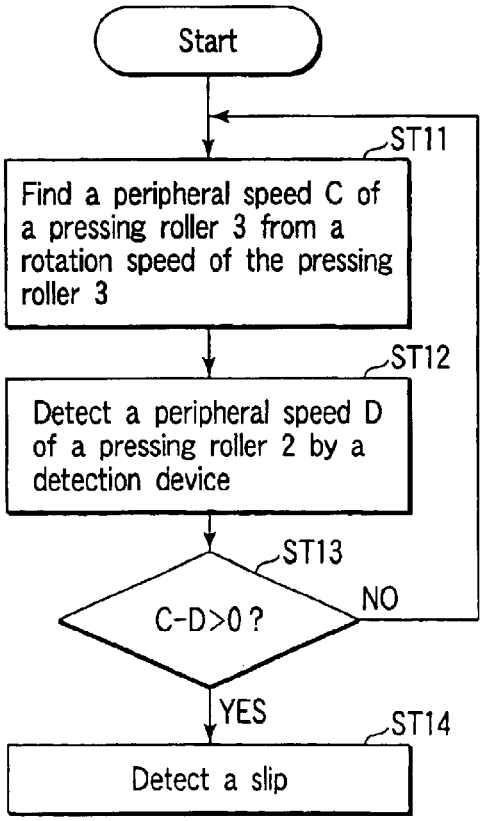
FIG. 9 is a flowchart showing a slip detection routine for the fixing apparatus of FIG. 8.

FIG. 9 is a flowchart showing the slip detection routine.

In this self-diagnostic routine, first, the peripheral speed C of the pressing roller 3 is found from the relation between the rotation speed (angular velocity) by a drive force loaded on the pressing roller 3 and the radius of the roller 3 (step ST11). Then, the peripheral speed D of the heating roller 2 is detected by a detecting means (step ST12).

In order to decide a large/small relation between these values C and D the difference C−D is found (step ST13).

The peripheral speeds C and D become equal when there is no slip between the rollers 2 and 3 and becomes C>D when there occurs a slip between the rollers 2 and 3. In the case where it is found that C−D>0 it is decided that a slip has occurred between the rollers 2 and 3 (step ST14).

In this case, the operation of the image forming apparatus is stopped and, in order to give the user, service personnel, etc., a notice to the effect that there has been a failure, it is displayed, for example, on a display panel of an operation section of the image forming apparatus. This slip detection routine always works when the roller as a speed detection target is rotated.

Although, in this embodiment, the speed difference is used for comparison between the peripheral speed values, any other values such as a speed ratio can be used and any comparison method may be used if the large/small relation between the values C and D can be compared.

Although, in this embodiment, the image forming apparatus is stopped in the case where a slip is detected between these rollers 2 and 3 by means of the slip detection routine, only the fixing apparatus or heating device may be stopped.

Further, although, in this embodiment, the slip detection routine has been explained as always working when the roller as a speed detection target is rotated, the roller may always work during the operation of the image forming apparatus. The scope of the present invention is not restricted to the time when the slip detection routine always work.

Although, in this embodiment, a drive force is loaded on the pressing roller 3 and the peripheral speed of the heating roller 2 is detected by a speed detection means, a drive force can, needless to say, be loaded on the heating roller 2 and the peripheral speed of the pressing roller 3 can be detected by the same method as set out above and that the slip detection can be made with the use of this value.

In the slip detection routine it is possible to detect a rotation failure of the roller resulting from a breakage of the roller on which a drive force is loaded. Needless to say, the slip detection routine can be used in the case where the endless member as already set out above is used as the pressing roller.

Figure 10:
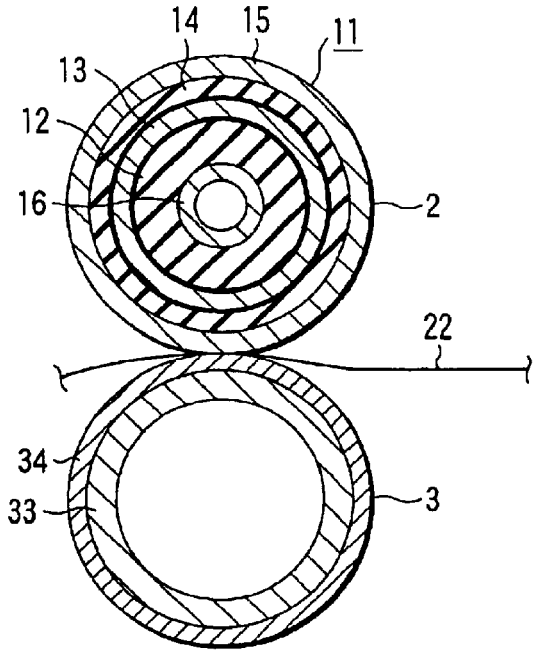
FIG. 10 is a schematic view showing a fixing apparatus according to a fourth embodiment of the present invention.

FIG. 10 shows a fixing apparatus according to a fourth embodiment of the present invention. The same reference numerals are employed to designate parts or elements corresponding to those shown in the first embodiment and further explanation of them is omitted.

In this embodiment, as a heating roller 2 use is made of an endless member 11 and a pressing roller 3 is of such a structure that a rubber layer 34 such as silicone and fluorine is coated around a core member 33. An elastic layer 12 4.73 mm thick is provided on the heating roller 2 side and a rubber layer 34 2 mm thick is provided on the pressing roller 3 side so that the heating roller 2 is made thicker and softer in surface hardness.

By doing so, it is possible to expect that, after a fixing process, a sheet p can be readily separated from the heating roller 2.

In this embodiment, the hardness of the heating roller 2 is made softer than that of he pressing roller 3 by varying the thickness of the rubber layers 12, 34. By using a softer rubber material for the heating roller 2 than for the pressing roller 3, the hardness of the heating roller 2 may be made softer than that of the pressing roller 3.

Figure 11:
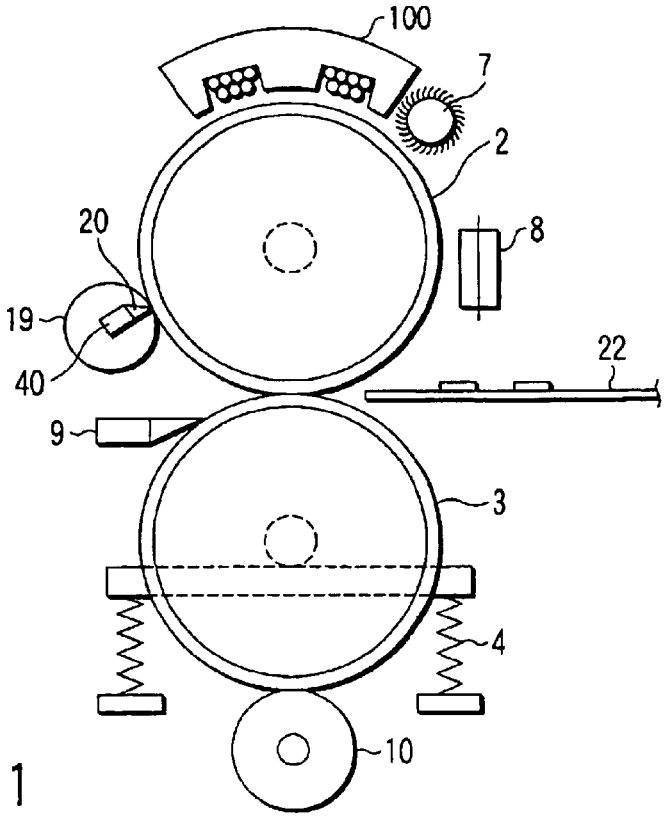
FIG. 11 is a schematic view showing a fifth embodiment of the present invention.

FIG. 11 is a schematic view showing a fixing apparatus according to a fifth embodiment of the present invention.

It seems that the endless member 11 is softer and readily deformable and that, during a prolonged period, it is more liable to be deformed and to be so due to a thermal expansion at the time of heating than expected.

Thus it is also considered that, in the structure of the first embodiment, the separation claw 5 on the heating roller 2 side is moved away from the surface of the roller 2 due to the deformation of the roller 2 and it is more forcibly urged against the roller then expected and does not function as expected.

Figure 12:
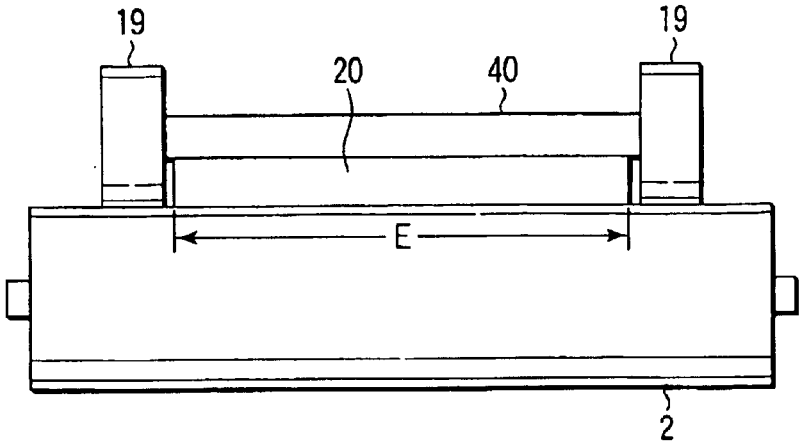
FIG. 12 is a plan view showing a separation device of the fixing apparatus of FIG. 11.

In the fifth embodiment, therefore, a separation blade 20 is retained by an adjusting blade 20 and positioning rollers 19, 19 are mounted on both ends to allow these rollers to abut against the surface of the heating roller 2 by means of an urging mechanism not shown. By doing so, as shown in FIG. 12, a given distance is always retained between the heating roller 2 and the separation blade 20 positioned by the positioning rollers 19, 19 to allow a sheet 22 which has been fixed to be separated.

The direction of the separation blade 20 is fixed by a guide not shown. In FIG. 12, E denotes an effective range of the separation blade 20 and this length is set to 310 mm and made wider than the width of the sheet 22.

Even where the heating roller 2 is deformed in such a structure, the positioning rollers 19, 19 follow such a deformation so that the distance between the roller 2 and the separation blade 20 is kept constant. Thus the separation blade 20 functions effectively.

Although, in this embodiment, the separation blade 20 is used, the separation claw may be used in the same method.

Figure 13:
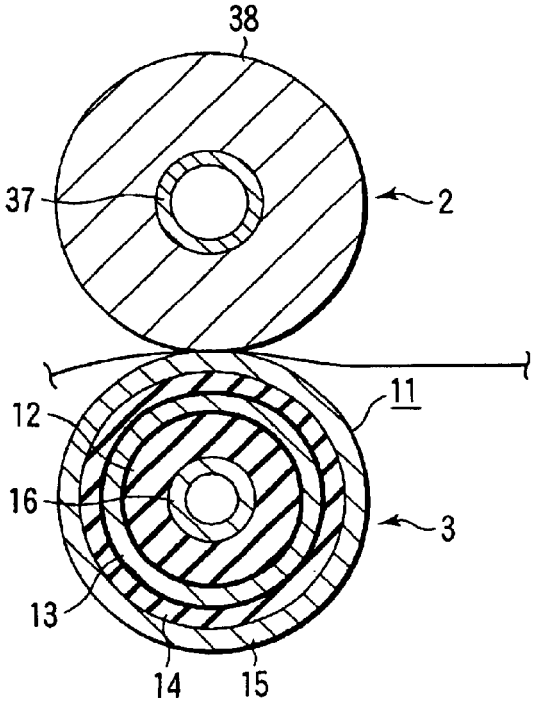
FIG. 13 is a cross-sectional view showing a fixing apparatus according to a sixth embodiment of the present invention.

FIG. 13 shows a sixth embodiment of the present invention. Here, the same reference numerals are employed to designate parts or elements corresponding to those shown in the first embodiment and further explanation of them is, therefore, omitted.

In this embodiment, an endless member 11 is used for the pressing roller 3 and a heating roller 2 is so formed that a rubber layer 38 of silicone or fluorine is covered around a core member 37. An elastic layer 12 on the pressing roller 3 side is set to 4.73 mm thick and the rubber layer 38 on the heating roller 2 side is set to 10 mm so that the surface hardness of the heating roller 2 is made softer.

It can be expected that such a structure ensures a readier separation of a sheet from the heating roller 2 after it has been fixed.

Although, in the present embodiment, the hardness of the heating roller 2 is made softer than that of the pressing roller 3, the hardness of the heating roller 2 may be made softer than that of the pressing roller 3 by using a softer rubber material for the heating roller than for the pressing roller 3.

Figure 14:
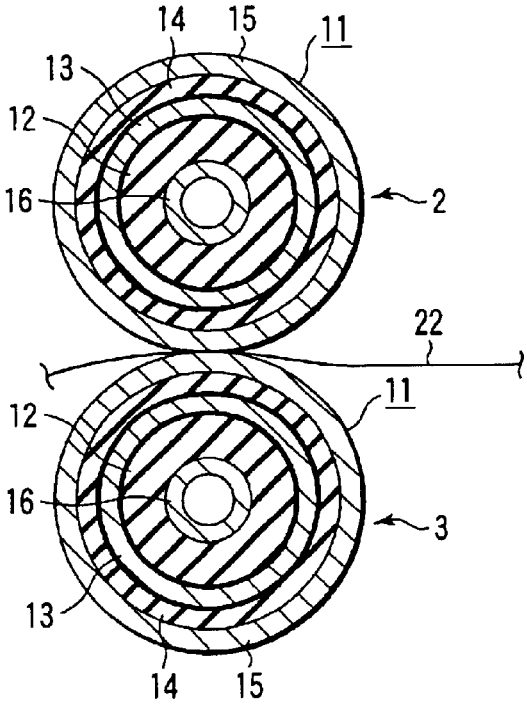
FIG. 14 is a cross-sectional view showing a seventh embodiment of the present invention.

FIG. 14 shows a fixing apparatus according to a seventh embodiment of the present invention. Here, the same reference numerals are employed to designate parts or elements corresponding to those shown in the first embodiment and further explanation of them is, therefore, omitted.

In the seventh embodiment, a heating roller 2 and pressing roller 3 are so formed as to have substantially the same structure except that different materials are used for their elastic layers 12. As the material for the elastic layer 12 on the heating roller 2 side, use is made of a foam rubber having an ASKER-C hardness of 10° while, on the other hand, as the material for the elastic material 12 on the pressing roller 3 side, use is made of a foam rubber having an ASKER-C hardness of 40°. That is, the hardness of the pressing roller 3 is set to be higher than that of the heating roller 2. This structure can ensure a positive separation of a sheet 22 from the heating roller 2 after it has been fixed.

Although, in this embodiment, the hardness of one roller is made different in material from that of the other roller by using different materials for the elastic layers 12 only, different materials and thicknesses are employed for all constituent elements in these two rollers, such as their elastic layers 12, conductive layers 13, elastic layers 14, mold releasing layers 15 and core members 16.

Since, by using different materials and thicknesses for those constituent elements of the endless member in these two rollers 2 and 3, the hardness and heat conductivity of the two rollers are varied and the designer can freely set them within a given range, it is possible to adjust the fixability of the fixing apparatus, the temperature raising rate at heating time and the heat capacity, and also to enhance the separability of a sheet.

Although, in the respective embodiments above, the heating roller 2 only is inductively heated, it is possible to also heat the pressing roller 3 at the same time by providing a flux generation coil 100 on the pressing roller 3 side or by setting a flux generation coil 100 at a location where it is possible to heat both the rollers 2, 3.

Further, although the induction heating apparatus is used as a system for heating the heating roller 2, other heating methods can be used without involving any problem. For example, use may be made of a reflector-equipped halogen lamp provided outside the heating roller 2 or resistive heat generation layer provided inside or outside the conductive layer 13 in the endless member 11.

Further, a flux generation coil may be provided inside the heating roller 2 to allow the heating roller 2 to be inductively heated from inside.

Further, although the heating roller 2, pressing roller 3, etc., are used as a rotation roller, a belt structure can be used in the case where the endless member 11 has no core member for example. The use of the belt as a rotation body is also covered within the scope of the essence of the present invention.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A fixing apparatus comprising:

a fixing device configured to, by allowing a material to be fixed having a developing agent image to pass between a heating rotation body and a pressing rotation body set in contact with the heating rotation body, fix the developing agent image, wherein at least one of the heating and pressing rotation bodies comprises an elastic rotation body having a core member, an elastic layer formed on a surface of the core member and a conductive layer formed on a surface side of the elastic layer;

a drive device configured to rotate the elastic rotation body by giving a rotation drive force to the core member of the elastic rotation body;

a detection device configured to detect a difference between rotation speeds of the surface portion and the core member at a rotation time of the elastic rotation body; and a determination device configured to determine that a failure has occurred based on the difference detected by the detection device.

2. The fixing apparatus according to claim 1, wherein the elastic layer is formed on an outer side of the conductive layer, and wherein the elastic layer and conductive layer are bonded by a heat-resistant adhesive having a heat-resistant temperature of over 200° C.

3. The fixing apparatus according to claim 1, wherein the detection device has a detection roller configured to be rotationally driven by the rotation of the elastic rotation body and to detect a peripheral speed of a surface of the elastic rotation body by measuring the rotation speed of the detection roller.

4. The fixing apparatus according to claim 1, wherein the detection device has an optical reading element configured to optically read a mark recorded on the surface of the elastic rotating body and to detect a peripheral speed of the surface of the elastic rotation body on the basis of read information of the optical reading element.

5. The fixing apparatus according to claim 1, further comprising:

a control device configured to stop the rotation of the elastic rotation body on the basis of an occurrence in which a difference between the rotation speeds of the surface portion and core member of the elastic rotation body that is detected by the detection device exceeds a predetermined value.

6. The fixing apparatus according to claim 1, wherein any one of the heating and pressing rotation bodies is configured to have an elastic layer and a conductive layer formed on a surface side of the elastic layer and the other rotation body is configured to have an elastic layer on a surface and said one rotation body is configured to be rotationally driven with the rotation of said other rotation body, and wherein the detection device is configured to detect a slip between said one and other rotation bodies from a difference between the peripheral speeds of these rotation bodies.

7. The fixing apparatus according to claim 1, wherein the heating and pressing rotation bodies have elastic layers, and wherein the thickness of the elastic layer of the pressing rotation body is thinner than that of the heating rotation body.

8. The fixing apparatus according to claim 7, wherein the hardness of the elastic layer of the pressing rotation body is higher than that of the elastic layer of the heating rotation body.

9. The fixing apparatus according to claim 1, wherein the heating rotation body and pressing rotation body are each configured to have an elastic layer and a conductive layer formed on a surface side of the elastic layer.

10. The fixing apparatus according to claim 9, wherein the elastic layer of the pressing rotation body is different in material from that of the heating rotation body.

11. The fixing apparatus according to claim 9, wherein the thickness of the elastic layer of the pressing rotation body is thinner than that of the elastic layer of the heating rotation body.

12. The fixing apparatus according to claim 9, wherein the hardness of the elastic layer of the pressing rotation body is higher than that of the elastic layer of the heating rotation body.

13. The fixing apparatus according to claim 9, wherein the thickness of the conductive layer of the pressing rotation body is thicker than that of the conductive layer of the heating rotation body.

14. The fixing apparatus according to claim 9, wherein the conductive layer of the pressing rotation body is different in material from that of the heating rotation body.

15. A fixing apparatus comprising:

a fixing device configured to, by allowing a material to be fixed having a developing agent image to pass between a heating rotation body and a pressing rotation body set in contact with the heating rotation body, fix the developing agent image and wherein at least one of the heating and pressing rotation bodies is comprised of an elastic rotation body having a core member, an elastic layer formed on the core member and a conductive layer formed on the elastic layer;

a drive device configured to rotate the elastic rotation body by giving a rotation drive force to the core member of the elastic rotation body; and a detection device configured to detect a difference between rotation speeds of a surface portion and a core portion of the elastic rotation body at a rotation time, wherein the detection device has a detection roller configured to be rotationally driven by the rotation of the elastic rotation body and detect a peripheral speed of a surface of the elastic rotation body by measuring the rotation speed of the detection roller.

16. A fixing apparatus according to claim 15, wherein the detection roller also acts as a cleaning roller for cleaning the surface of the elastic rotation body.

* * * * *